United States Patent [19]

Wallis

[11] Patent Number: 4,699,311

[45] Date of Patent: Oct. 13, 1987

[54] EGG CARTON WITH OVERWRAP

[76] Inventor: Marvin E. Wallis, 5535 Longfellow Rd., Santa Barbara, Calif. 93111

[21] Appl. No.: 930,921

[22] Filed: Nov. 17, 1986

[51] Int. Cl.[4] ..... B65D 85/32

[52] U.S. Cl. ..... 229/2.5 EC; 206/45.31; 206/45.33; 206/831; 229/DIG. 12

[58] Field of Search ..... 229/2.5 EC, 44 EC, 45 EC, 229/DIG. 12; 206/45.31, 45.34, 45.33, 831

[56] References Cited

U.S. PATENT DOCUMENTS

| | | | |
|---|---|---|---|
| 3,192,050 | 6/1965 | Almquist | 206/45.33 |
| 3,411,693 | 11/1968 | Macchi | 229/2.5 EC |
| 3,556,387 | 1/1971 | Trimble | 229/2.5 EC |
| 3,741,461 | 6/1973 | Hassing-Hansen | 229/2.5 EC |
| 4,335,813 | 6/1982 | Bessett et al. | 229/2.5 EC |
| 4,352,427 | 10/1982 | Lake | 229/2.5 EC |
| 4,475,653 | 10/1984 | Ullman | 206/45.33 |

FOREIGN PATENT DOCUMENTS

| | | | |
|---|---|---|---|
| 835172 | 2/1970 | Canada | 229/2.5 EC |
| 1113339 | 5/1968 | United Kingdom | 229/2.5 EC |
| 1182105 | 2/1970 | United Kingdom | 229/2.5 EC |

*Primary Examiner*—Stephen Marcus

*Assistant Examiner*—Gary E. Elkins

*Attorney, Agent, or Firm*—Finnegan, Henderson, Farabow, Garrett & Dunner

[57] ABSTRACT

An improved egg carton comprising a container having a plurality of cup-shaped receptacles aligned in a plurality of rows, each of which are conformed to and adapted to receive a vertically positioned egg. A plurality of posts are positioned between the rows of eggs. The carton also includes a pair of upper sidewalls integrally hinged along hinge lines on opposite sides of the container. The upper sidewalls are normally biased toward a substantially horizontal position to permit eggs to be placed in the receptacles. The upper sidewalls have a sufficient length to extend at least to the outer edge of the first and last eggs in the rows of eggs and have a height sufficient to extend above the upper ends of the eggs when the upper sidewalls are aligned in a vertical position. A hot sealant is applied to the hinge lines, causing the upper sidewalls to remain in the vertical position. A clear plastic film is forced over and around upper portions of the eggs extending out of the container. The film is drawn down around a portion of the eggs adhering to the tops of the posts and also being secured to the hinge lines.

13 Claims, 4 Drawing Figures

EGG CARTON WITH OVERWRAP

BACKGROUND OF THE INVENTION

The present invention relates to an improved container for use in the commercial sale and distribution of eggs and to a novel method for packaging eggs. The present invention finds particular utility in providing a container which affords visibility of the eggs, yet offers a high level of protection against breakage.

In buying eggs, consumers generally open the lid of conventional opaque containers to look at the contents before making a purchase. On occasion, the contents of these conventional containers are exchanged with more expensive eggs from other containers, thus increasing the risk of damage both to the eggs and the container, while causing a corresponding loss to the supermarket.

Efforts at developing see-through egg containers of sturdy construction have heretofore not been entirely satisfactory. Currently used containers employing a clear plastic film or overwrap are susceptible to excessive egg breakage. Generally, these films are loosely formed over the upper surface of the eggs and are unable to retain the eggs fixedly in their preformed receptacle during handling of the container. Other methods sacrifice visibility for reduced vulnerability by providing a small hole in the container surface, exposing only a limited portion of the egg shell. The small hole does not permit adequate examination of the contents before purchase.

Some egg carton manufacturers make available containers having flaps which must be raised before wrapping the container with a plastic covering. These flaps are designed to offer some protection to the sides of the eggs. Since the natural disposition of the flaps is horizontal, there is a tendency for the flaps to return to that position. This causes the overwrap to stretch and become loose. Further, these flaps offer no protection to the top surface of the eggs, creating an obvious limitation on verticaly stacking the cartons.

Another problem existing in the prior art involves heat shrinking a plastic film onto the container for providing a tight seal. The heat shrinking process requires use of excessive heat, which can detract from the freshness and overall quality of the packaged eggs. Furthermore, when such plastic is handled, it becomes loose, thus increasing the potential for damage to the contents.

Covering an egg container with transparent wrapping ordinarily requires a considerable amount of plastic film material. In conventional practice, the film is wrapped around the entire container, i.e., bottom, top and sides. The amount of film currently used to envelop the eggs and the container is more than double the amount of film used by the present invention. On a volume basis, the amount of film used amounts to a considerable operating expense.

Present methods of packaging eggs also entail the use of preprinted containers for the purpose of identifying brand name, egg size and other data customarily provided in the marketing of eggs. A large egg processor servicing several egg distributors necessarily must maintain an extremely large supply of cartons. Storage space considerations and production costs of packaging products are constant marketing problems.

Accordingly, it is an object of the invention to provide a sturdy egg container permitting the consumer to view a substantial portion of the contents while also supporting the eggs in a way reducing potential breakage.

Another object of the present invention is the provision of a carton exposing a substantial portion of eggs for viewing while protecting both the sides and the top of the eggs so that the cartons may be vertically stacked.

Another object of the invention is the provision of an egg carton having upper sidewalls permanently biased to a vertical position preventing stretching of a plastic encasing film.

Another object of the present invention is covering the top surface of eggs in a carton with clear plastic forming a supporting surface retaining the eggs in place in an upright position.

Another object of this invention is securing a plastic supporting cover over eggs in a carton without use of excessive heat thereby ensuring a fresh product.

Another object of the present invention is applying a plastic film over the top and sides of the eggs to reduce the escape of carbon dioxide from the eggs, thereby preventing premature spoilage of the egg.

Another object of the present invention is minimizing the amount of plastic film used to envelop an egg carton while providing maximum egg supporting strength.

A further object of the present invention is the provision of an efficient method of packaging eggs reducing cost of production while simultaneously enhancing marketing flexibility.

A still further object of the present invention is the provision of a common egg carton capable of having any one of a number of various merchandising labels attached.

Additional objects and advantages of the invention will be set forth in part in the description which follows and in part will be obvious from the description, or may be learned by practice of the invention. The objects and advantages may be realized and attained by means of the instrumentalities and combinations particularly pointed out in the appended claims.

To achieve the objects and in accordance with the purpose of the invention, as embodied and broadly described herein, the egg carton of this invention comprises a container having a plurality of cup-shaped receptacles aligned in a plurality of rows, each receptacle conforming to and adapted to receive a vertically positioned egg, a plurality of posts between the rows, a pair of upper sidewalls integrally hinged along hinge lines on opposite sides of the container, the upper sidewalls being normally biased toward a substantially horizontal position to permit placing eggs in the receptacle, the upper sidewalls having a sufficient length to extend at least to the outer edge of the first and last eggs in the rows and a height sufficient to extend above the upper ends of the eggs when the upper sidewalls are aligned in a vertical position, a hot sealing means applied to the hinge lines, the sealing means formed on the hinge line causing the upper sidewalls to remain in the vertical position, the container having a clear plastic film applied over and around upper portions of the eggs extending out of the container, the film being forced down around a portion of the eggs and adhering to the tops of the posts, and the film being secured to the hinge lines.

The present invention further includes a method of packaging eggs comprising the steps of providing a container having a plurality of receptacles receiving vertically positioned eggs, the container also having integrally hinged upper sidewalls normally biased in horizontal open positions along respective hinge lines on opposite sides of the container, the container further comprising a plurality of posts between the receptacles; placing eggs in each of said receptacles; pivoting the sidewalls toward a vertical covering position, partially covering the eggs, while leaving a substantial portion of the eggs exposed for viewing; applying a hot sealant along each of said hinge lines allowing said sidewalls to retain said vertical position; extruding a high speed plastic film at exposed portions of said eggs and said upper sidewalls and simultaneously applying a low vacuum to the container; and covering the upper exposed end portions of the eggs and sidewalls with a clear, thermally responsive plastic film. The method of the present invention also includes the steps of sealing the plastic film to the hinge lines; adhering the plastic film to a portion of the top of the posts; and attaching at least one label to a surface of one of the sidewalls.

The accompanying drawings, which are incorporated in and constitute part of this specification, illustrate one embodiment of the invention and, together with the description, serve to explain the principles of the invention.

DESCRIPTION OF THE PREFERRED EMBODIMENT

Reference will now be made in detail to the presently preferred embodiment of the invention, an example of which is illustrated in the accompanying drawings.

Figure 1:
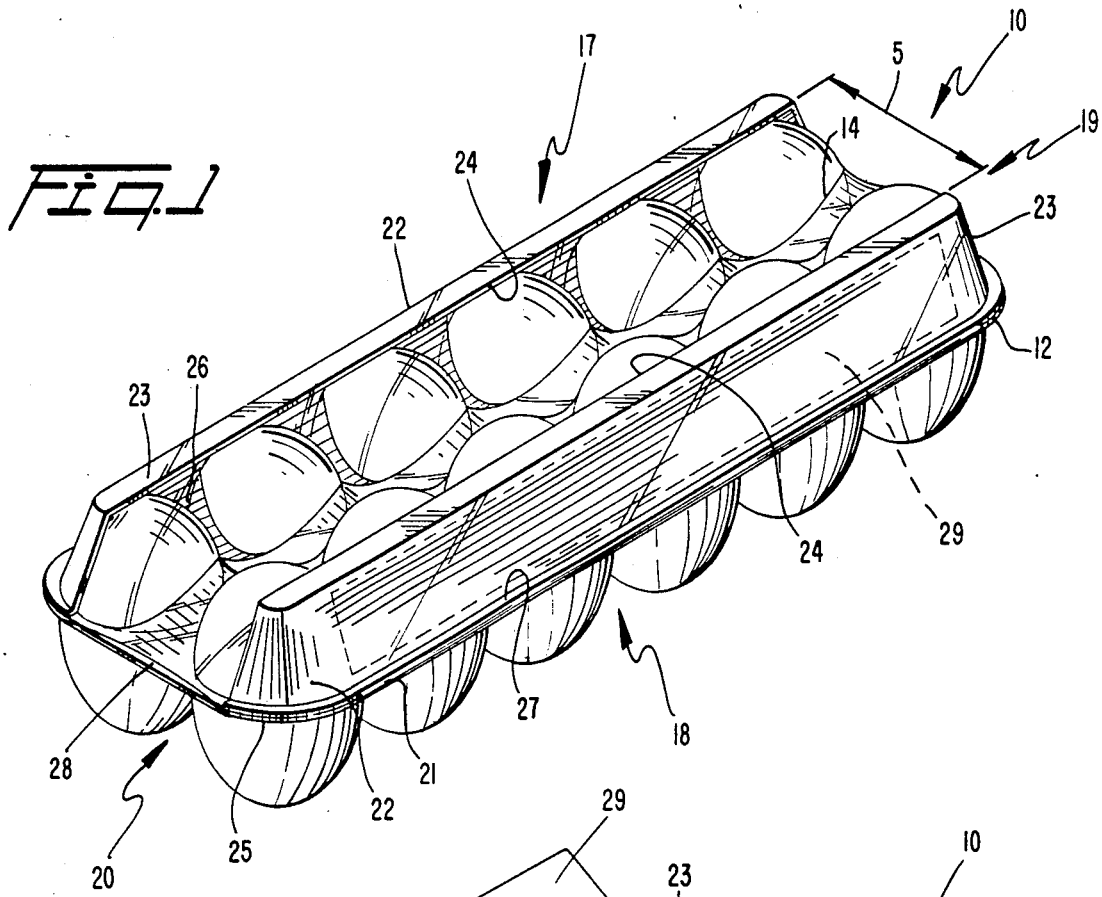
FIG. 1 is a perspective view of the preferred embodiment of an egg carton constructed in accordance with the present invention.

With reference to FIG. 1, an egg carton constructed in accordance with this invention is represented generally by the numeral 10. Egg carton 10 comprises a container 12 having a plurality of cup-shaped receptacles 14 aligned in a plurality of rows, each receptacle conforming to and adapted to receive a vertically position egg. Generally, the carton may consist of two or three rows with six receptacles in each row; however, the number of receptacles may be varied to fit particular needs or desires. A plurality of posts 16 are integrally formed within container 12, between any group of four receptacles, interconnecting the receptacles and making the container more rigid. Posts 16 are approximately one-half the vertical height of the eggs.

Figure 2:
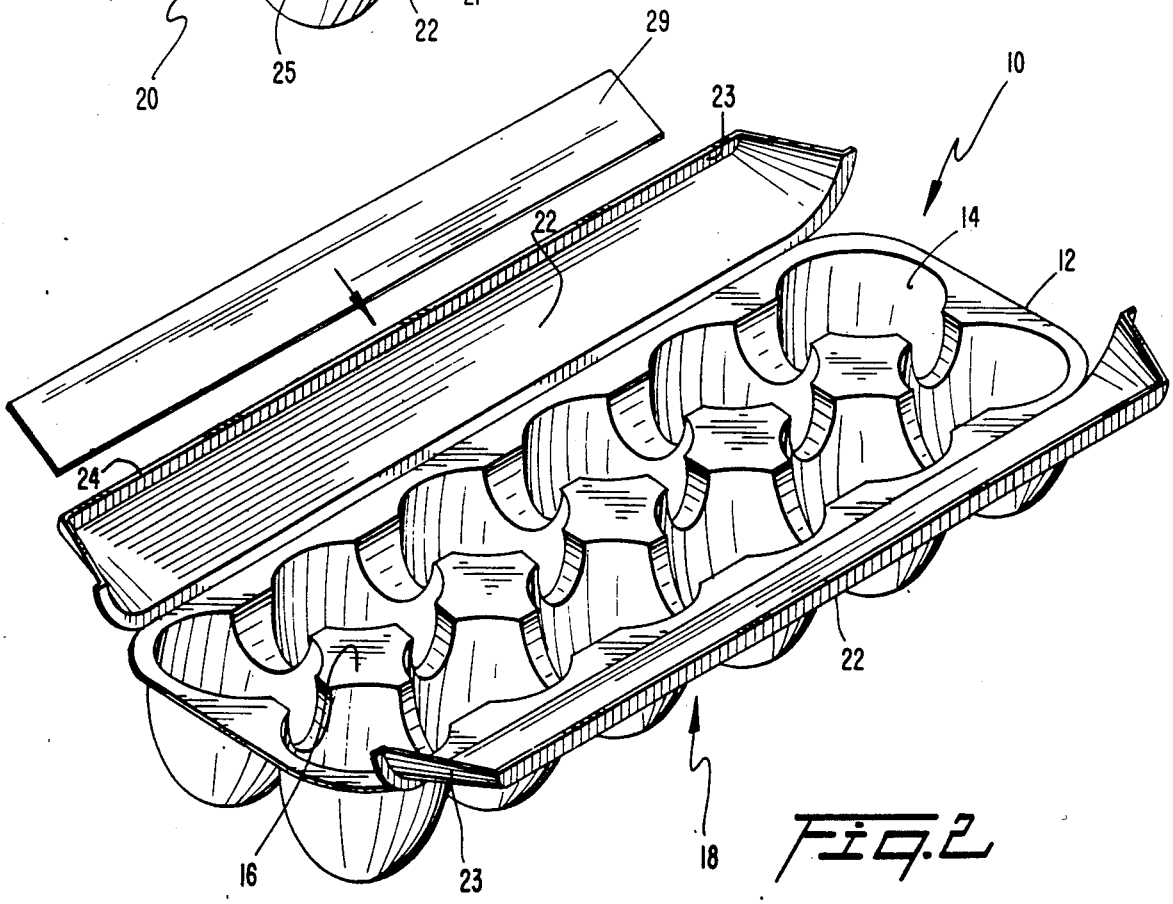
FIG. 2 is a perspective view of an uncovered egg carton of FIG. 1 having sidewalls positioned in a horizontal position and a detached advertising label.

Container 12 is defined by two sides 17 and 18 and two ends 19 and 20. A pair of upper sidewalls 22 are integrally hinged along hinge lines 21 on sides 17 and 18. As shown in FIG. 2, sidewalls 22 are normally biased toward a substantially horizontal position permitting eggs to be placed in receptacles 14. Sidewalls 22 have a sufficient length to extend at least to the outer edge of the first and last eggs in the rows. The outer edge is defined as the axially aligned outer edge of the first and last eggs in the rows. Sidewalls 22 also have a height sufficient to extend above the upper ends of the eggs when upper sidewalls 22 are aligned in a vertical position.

Sidewalls 22 also have an arcuately shaped top surface 23 along the length and height of sidewalls 22, as illustrated in FIG. 1. An end surface 24 on each of sidewalls 22 is interiorly aligned in the direction of the opposing sidewall. This creates an open space 5 between the opposing end surfaces 24 across the top of the egg carton, when sidewalls 22 are aligned in the vertical position, permitting a customer to view the eggs prior to purchase.

In accordance with the invention, a hot sealing means is applied at hinge lines 21, when the sidewalls 22 are held in the vertical, thereby changing the horizontal bias of upper sidewalls 22, causing both to remain in the vertical position. As embodied herein, the sealing means comprises a bead 25 of thermoplastic material applied on the outer surface of hinge lines 24, which protrudes slightly outward from the surface of container 12. Application of the hot thermoplastic material breaks a normal bias of upper sidewalls 22 toward a horizontal position, shown in FIG. 2, so that sidewalls 22 are biased to a vertical position shown in FIG. 1. The horizontal force previously present causing the sidewalls to spring back to a normal horizontal position is therefore removed.

Preferably, an automatic hot melt application system capable of accurately applying a line or bead of hot melt wax, plastic, or adhesive about 1/16 inch in thickness along each hinge line 21 is used. The bead is applied when both sides of the container are held in an upright position. The heat from the hot melt wax breaks the horizontal bias of the upper sidewalls. Thereafter, sidewalls 22 are supported temporarily in the vertical position while the hot melt cools. After adequate cooling, sidewalls 22 remain in the vertical, as shown in FIG. 1, without support.

In accordance with the invention, a biaxially oriented plastic film 26 is wrapped over the exposed portions of the eggs and the outer surface of vertically positioned upper sidewalls 22. Preferably, a packaging machine such as disclosed by U.S. Pat. No. 3,043,096 to Wallis is used to apply plastic film 26. Plastic film 26 may be extruded in a semi-solid state at a high velocity of approximately 400–450 FPM. The high velocity and a low vacuum air suction, a function of the packaging machine, instantly forces the pliable, semi-solid plastic down over the top and sides of the eggs.

Figure 3:
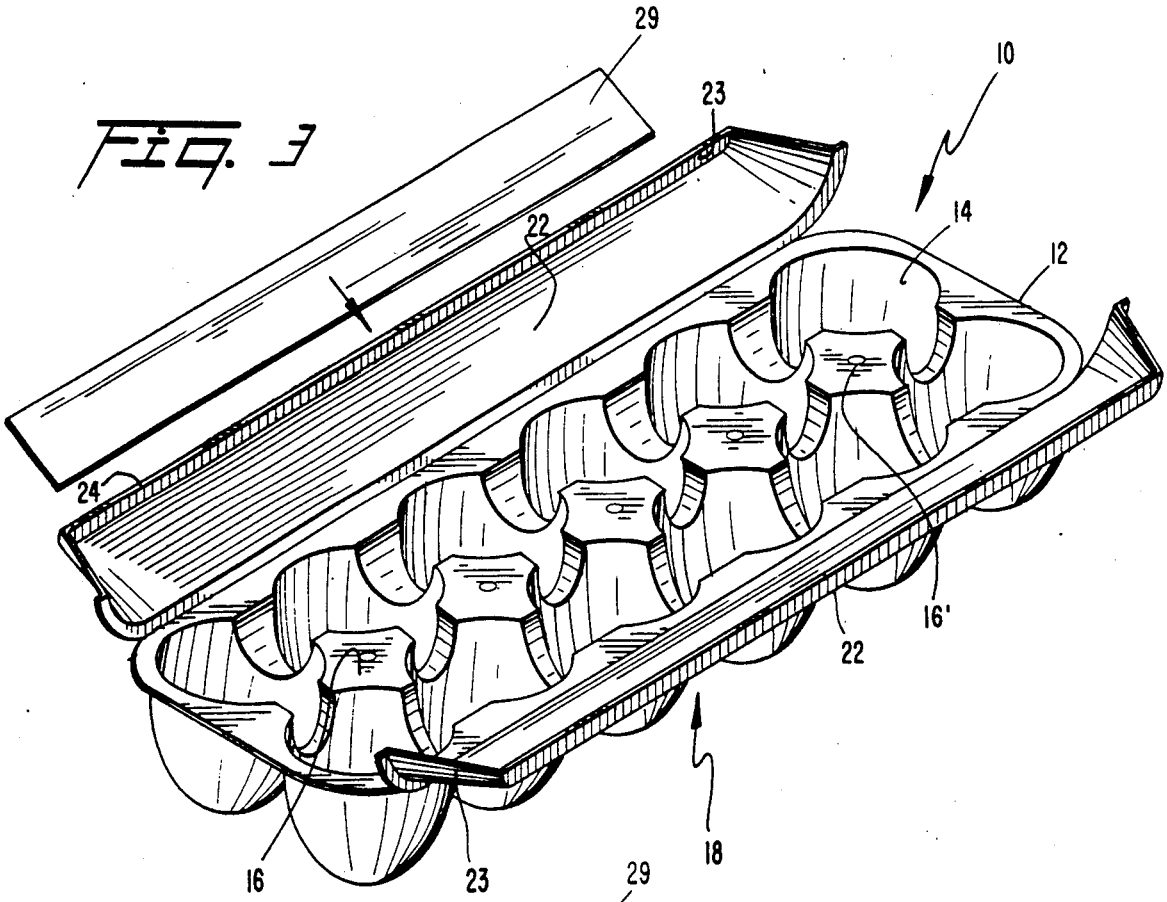
FIG. 3 is a perspective view of another embodiment of an uncovered egg carton similar to FIG. 1 having sidewalls positioned in a horizontal position and a detached advertising label.
Figure 4:
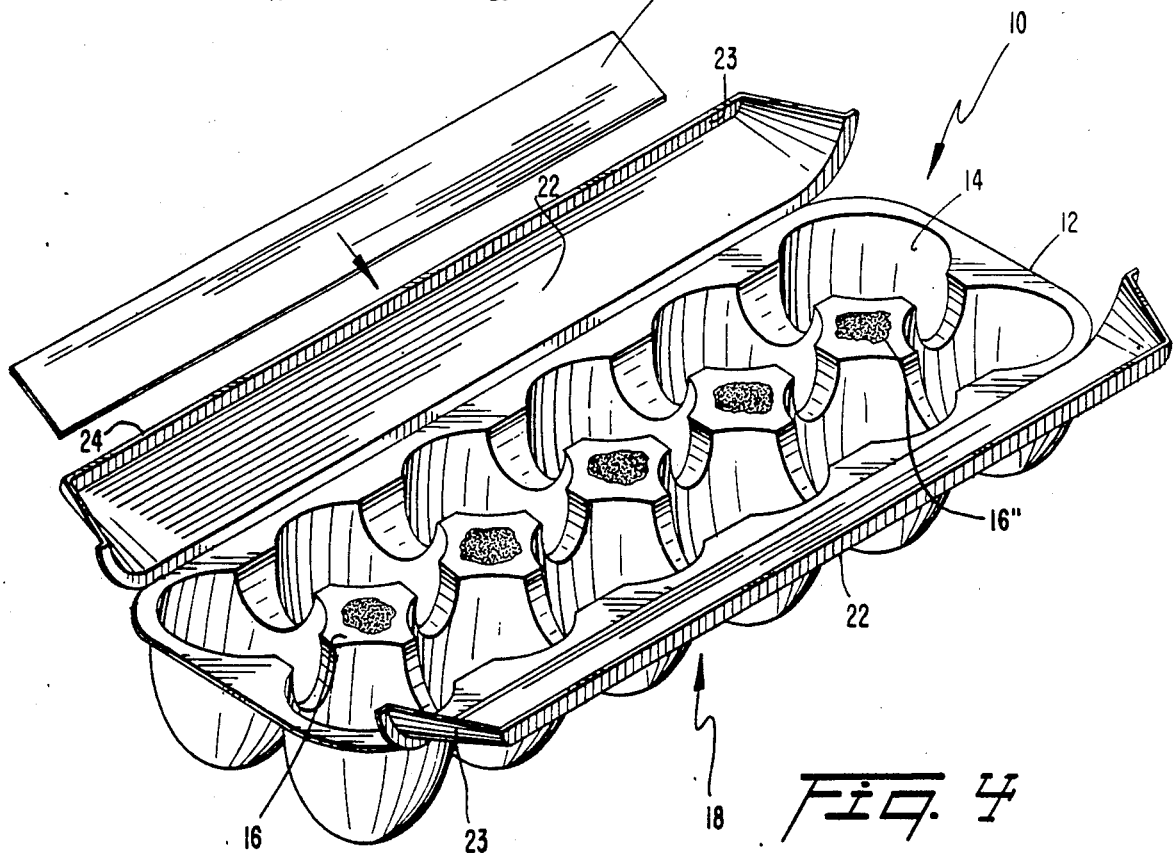
FIG. 4 is a perspective view of still another embodiment of an uncovered egg carton of FIG. 1 having sidewalls positioned in a horizontal position and a detached advertising label.

Film 26 adheres to the hot melt bead 25 applied to hinge lines 21. Bead 25 is preferably tacky (sticky) and insures a positive seal between film 26 and container 12, even after bead 25 has cooled. In addition, a portion of the top of each post 16 is either porous (FIG. 2) or contains a hole 16' (approximately $\frac{1}{4}$ inch in diameter), as shown in FIG. 3. The porous portion of posts 16 and the hole 16' provide a low vaccum within container 12, enabling the plastic film 26 to be drawn down around the eggs resulting in the film being sealed to the top of each post 15. Alternatively, the top of each post 16 may also be coated with an adhesive 16'', as shown in FIG. 4, for securing the plastic to the post 16. Adhering film 26 to posts 16 and covering the exposed top portion of the eggs permits film 26 to position the eggs firmly within receptables 14, while also providing a releasable surface to which film 26 may bind. Accordingly, the film 26 is drawn around the eggs, locking the film 26 to the container 12 using low vacuum, which does not cause damage to the eggs.

Film 26 further adheres to end 19, but is not sealed along end 20 of container 12. End 20 therefore provides a small air passage 28 between film 26 and the upper surface of end 20. By attaching film 26 along hinge line beads 25, it is only necessary to use enough plastic film to cover the container between the respective hinge lines 21. The viability of film 26 as an effective covering is enhanced by removing the horizontal bias of sidewalls 22 eliminating the stretching force of sidewalls 22 against film 26.

In accordance with the present invention, a preprinted label or coupon 29 can be affixed to an outer substantially vertical surface 27 of upper sidewalls 22. Normally, label/coupon 29 is attached before eggs are placed in the container. Preferably, a pair of printed labels are selectively attached to outer surfaces 27 of both upper sidewalls 22. For example, one label may identify any government packaging requirements, while the other label may be used for advertisements and/or universal price code information. In addition, a strip or perforated coupon may be used as the film affords a protective covering for coupon merchandising, thereby minimizing the likelihood of in-store pilfering. The attaching surface of label 29 may be coated with a silicone-type adhesive. A label 29 is shown in phantom attached to a surface 27 in FIG. 1. After film 26 is applied, the eggs and labels can be clearly seen through the transparent plastic film 26.

The present invention further includes a means for opening a film enclosed container 12. As embodied herein, the sealed carton may be opened along hinge line 21 at a tear line in film 26, as is disclosed by U.S. Pat. No. 3,899,283 to Wallis. Alternatively, the outer surface of one or both labels affixed to at least one of the upper sidewalls 22, may be coated with a material compatible with film 26, such as micro-crystalline wax having a high melt point of 180°–200° F., thereby allowing the film to adhere to the label. With this arrangement, film 26 can be resealed by pressing the film firmly against the label. Additionally, the carton may also be conveniently opened by pulling the portion of film 26 which forms air passage 28 along container end 20.

Covering the eggs with a clear plastic film permits a consumer to determine whether any breakage of eggs has occurred without the necessity of opening the carton. The sealed film also prevent eggs from being shifted from one carton to another. In addition, the film covering adheres to the exposed surface of the egg reducing the loss of carbon dioxide within the egg shell, thereby preserving freshness of the eggs.

It will be apparent to those skilled in the art that various modifications and variations can be made in the egg carton of the present invention and in the method of packaging eggs without departing from the scope and spirit of the invention. As an example, there can be more than one method of producing and applying the film covering the upper exposed portions of the eggs and their container. Thus, it is intended that the present invention cover modifications and variations of this invention provided they come within the scope of the appended claims and their equivalents.

What is claimed is:

1. An egg carton comprising:

a container having a plurality of cup-shaped receptacles aligned in a plurality of rows, each receptacle conforming to and adapted to receive a vertically positioned egg;

a plurality of posts between said rows;

a pair of upper sidewalls integrally hinged along hinge lines on opposite sides of said container, said upper sidewalls being normally biased toward a substantially horizontal position to permit placing eggs in said receptacles, said upper sidewalls having a sufficient length to extend at least to an outer edge of a first and last of said eggs in said rows and a height sufficient to extend above upper ends of the eggs when said upper sidewalls are aligned in a vertical position;

a thermoplastic adherent bead applied to said hinge lines to break the horizontal bias of said upper sidewalls causing said upper sidewalls to remain in the vertical position without support when said thermoplastic bead is cooled; and said container having a clear plastic film applied over and around upper portions of said eggs extending out of said container, the film being forced down around a portion of the eggs, said plurality of posts having means disposed on tops of said posts for providing a vacuum within said container when said film is applied over and around said eggs, said vacuum means adhering said film to the tops of said posts, said film also being secured to said bead along said hinge lines.

2. The egg carton as recited in claim 1, wherein said upper sidewalls are spaced apart, when aligned in the vertical position, to provide an open space across the top of said egg carton, allowing said eggs to be viewed through said film.

3. The egg carton as recited in claim 1, wherein said film is not attached along at least one end of said container permitting air to flow through said open end.

4. The egg carton as recited in claim 1 including means for opening and closing said film about said container.

5. The egg carton as recited in claim 1, wherein at least one label is attached to an outwardly exposed planar surface of at least one of said upper sidewalls.

6. The egg carton as recited in claim 1, wherein said vacuum means includes porous material formed along a portion of the top of said posts allowing said film to be drawn into engagement with and secured thereto through the application of heat and a vacuum to said container.

7. The egg carton as recited in claim 1, wherein said vacuum means includes at least one hole formed on the top of said posts allowing said film to be drawn into engagement with and secured thereto through the application of heat and a vacuum to said container.

8. The egg carton as recited in claim 1, wherein an adhesive is also applied to a portion of the top of said posts, allowing said film to be secured thereto.

9. An egg carton as recited in claim 1, wherein a detachable coupon is affixed to an outwardly exposed planar surface of at least one of said upper sidewalls, said film providing a protective covering for said coupon.

10. An egg carton comprising:

a container having a plurality of cup-shaped receptacles aligned in a plurality of rows, each receptacle conforming to and adapted to receive a vertically positioned egg;

a plurality of posts between said rows;

a pair of upper sidewalls integrally hinged along hinge lines on opposite sides of said container, said upper sidewalls being normally biased toward the horizontal position to permit placing eggs in said receptacles, said upper sidewalls having a sufficient length, to extend at least to an outer edge of a first and last of said eggs in said rows facing end of said container and a height sufficient to extend above upper ends of the eggs, while providing a viewing space therebetween when said upper sidewalls are aligned in a vertical position;

a thermoplastic adherent bead applied to said hinge lines to break the horizontal bias of said upper sidewalls causing said upper sidewalls to remain in the vertical position without support when said thermoplastic bead is cooled; and said container having a clear plastic film applied over and around upper portions of said eggs in said viewing space and between said sidewalls to reduce the escape of carbon dioxide from the eggs within said container, said plurality of posts having means disposed on tops of said posts for releasably adhering said film to said plurality of posts when said film is applied over and around said eggs, said film also being secured to said bead along said hinge lines.

11. The egg carton as recited in claim 10, wherein said adhering means includes porous material formed along a portion of the tops of said posts allowing said film to be drawn into engagement with and secured thereto through the application of heat and a vacuum to said container.

12. The egg carton as recited in claim 10, wherein said adhering means includes at least one hole formed on the top of said posts allowing said film to be drawn into engagement with and secured thereto through the application of heat and a vacuum to said container.

13. The egg carton as recited in claim 10, wherein said adhering means includes an adhesive applied to a portion of the top of each of said plurality of said posts.

* * * * *